US006676065B1

(12) United States Patent
Kashima

(10) Patent No.: US 6,676,065 B1
(45) Date of Patent: Jan. 13, 2004

(54) WEB WINDING METHOD AND APPARATUS THEREFOR

(75) Inventor: Toshio Kashima, Hirakata (JP)

(73) Assignee: Fuji Tekko Co., Ltd., Osaka (JP)

( * ) Notice: Subject to any disclaimer, the term of this patent is extended or adjusted under 35 U.S.C. 154(b) by 0 days.

(21) Appl. No.: 10/254,487

(22) Filed: Sep. 25, 2002

(30) Foreign Application Priority Data

Jul. 10, 2002 (JP) ..... 2002-200685

(51) Int. Cl.[7] ..... B65H 18/10; B65H 19/30

(52) U.S. Cl. ..... 242/533.4; 242/160.1; 242/610.1

(58) Field of Search ..... 242/533.4, 533.5, 242/533.6, 899, 610.1, 610.2, 160.1, 160.4; 156/203, 218, 466; 493/304

(56) References Cited

U.S. PATENT DOCUMENTS 309,332 A * 12/1884 Clarke ..... 242/160.1
1,441,260 A * 1/1923 Womelsdorf ..... 493/304
1,882,012 A * 10/1932 Hires ..... 242/160.1
3,930,620 A * 1/1976 Taitel ..... 242/533.4
3,952,963 A * 4/1976 Ueno et al. ..... 242/610.1
4,080,879 A * 3/1978 Hoden et al. ..... 493/304
4,270,443 A * 6/1981 McSwiney et al. ..... 493/304
4,630,783 A * 12/1986 Mulfarth ..... 242/533.4
4,655,738 A * 4/1987 Jansson ..... 493/304
4,783,015 A * 11/1988 Shimizu ..... 242/160.1

* cited by examiner

*Primary Examiner*—John M. Jillions
(74) *Attorney, Agent, or Firm*—Flynn, Thiel, Boutell & Tanis, P.C.

(57) ABSTRACT

To shape paperboard sheets into cylindrical winding cores in a winder instead of using ready-made hollow core tubes thereby doing away with the necessity of waste disposal of used winding cores or facilitating the discarding disposal by restoring them to the original flat shape. In the winding of a web using a multi-spindle turret type of winder, the spindle positions of the turret are allotted to a winding core shaping station, a web winding-up station and a wind-roll removal station. At the winding core shaping station, each sheet of paperboard is rolled and lapped around a winding core shaft and butt joining parts are attached with a pressure-sensitive adhesive tape to shape each winding core, shaped winding cores are transferred to the web winding-up station by the turning movement of the turret to conduct the winding, each full wind-up roll is transferred with further turning movement to the removal station and removed from the winder.

6 Claims, 7 Drawing Sheets

WEB WINDING METHOD AND APPARATUS THEREFOR

BACKGROUND OF THE INVENTION

1. Field of the Invention

This invention relates to a web winding method and an apparatus therefor by use of a turret type of winder, and more particularly, to the web winding method and the apparatus for shaping each sheet of paperboard into a cylindrical winding core within the winder instead of using ready-made paper core tubes and winding up a web onto the shaped winding cores.

2. Description of the Related Art

In the winding of a long-length web by the instrumentality of a turret winder, particularly in the case of such a soft plastic film or a thin paper that cannot retain a wind-up roll form, relying on a rigidity of the web itself, it has hitherto been the common practice to wind the web up on winding cores in the form of hollow cylindrical paper tubes or plastic tubes preliminarily manufactured as such.

Where a web is thus wound up on such ready-made winding core tubes as stated above, however, when the web is unwound from wind-up rolls thus produced and used up, these hollow cylindrical winding cores are left behind as useless objects or industrial wastes. Nowadays it becomes unable to discard and dispose of the used core tubes easily even though they are paper tubes. If they will be reused, then a troublesome work and an extra cost might be entailed for collecting, sorting, transportation, or any other control of them.

In the circumstances, with a view to solving the issue of disposal of such wastes of core tubes from an environmental viewpoint, the present inventor has investigated into any alternative winding method and its apparatus. As a result, this invention has been made by developing a new method and an apparatus for winding a web on such easily disposable winding cores that do not produce industrial wastes to be discarded, but are reusable at a low cost. In the course of the development of this invention, a so-called coreless wrap of stretch film has been recently reported. Reportedly, this is a product of a stretchable film wound on a new type of winding core that is made from a sheet of paperboard into a cylinder form instead of using paper tubes as a winding core, but further details on it, such as its manufacturing method and apparatus are not published at all.

In the light of the present state of the art, this invention is designed to propose an independently new efficient web winding method by preparing cylindrical tubes from sheets of paperboard on a winder instead of using conventional ready-made paper tubes as mentioned above and an apparatus for embodying the method. Accordingly, it is a primary object of the invention to conduct a shaping operation of winding cores from sheets of paperboard efficiently and in sequential steps within a winder. Further object is to facilitate the restoration of the winding cores to the original paperboard sheets, even though the winding cores in a hollow cylindrical form remain useless after the web is unwound from resulting wind-up rolls and used up, thereby doing away with the necessity of disposing of the used winding cores as industrial wastes or enabling the reuse of the restored paperboard sheets, if needed.

SUMMARY OF THE INVENTION

The present invention for attaining the foregoing objects resides in a method, of winding up a web on winding cores by use of a multiple-spindle turret type of winder, which comprises the sequential steps of rolling and lapping each sheet of paperboard around a winding core shaft and attaching butt joining parts of both edges of the paperboard sheet with a pressure-sensitive adhesive tape, thus shaping paperboard sheets into winding cores; winding up a web onto the shaped winding cores; and subsequently, removing full wind-up rolls wound on the winding cores out of the winder, the aforesaid sequential steps being conducted in conformity with the turning movement (indexing) of the turret within the winder.

The invention resides further in a multiple-spindle turret type of winder for carrying the foregoing method into effect wherein the spindle positions of the turret are allotted to a winding core shaping station, a web winding-up station and a wind-up roll removal station; which winder is equipped, in association with the aforesaid winding core shaping station, with a winding core shaping apparatus for shaping paperboard sheets one by one into winding cores; a web winding-up device; and a removal device of full wind-up rolls out of the winder. In that winder, the winding core shaping apparatus comprises transfer means of transferring paperboard sheets one by one to a tape application bedplate on which to attach and adhere a pressure-sensitive adhesive tape to each paperboard sheet; tape applying means for unreeling the adhesive tape from an adhesive tape roll, cutting it in an adequate length and applying the cut adhesive tape to one edge of each paperboard sheet thus transferred to the tape application bedplate; transfer means of transferring the tape-attached paperboard sheet thus treated to the winding core shaping station where to shape the paperboard sheets into the winding cores; and winding core shaping means for rolling and lapping each sheet of paperboard thus transferred around a winding core shaft positioned at the winding core shaping station of the turret and uniting butt joining parts of both edges of the paperboard sheet together with the adhesive tape; the winding core shaping apparatus, the web winding-up device and the removal device of windup rolls are capable of operating in sequence in association with the winding core shaping station, the web winding-up station and the removal station, respectively in conformity with the turning movement of the turret.

According to this invention, for example, where a three-spindle turret type of winder is used, first, a sheet of paperboard is picked up from a table stacked with paperboard sheets and transferred to the tape application bedplate for an adhesive tape. Concurrently, the adhesive tape is unreeled from an adhesive tape stock roll located in the vicinity of the bedplate and cut in an appropriate length into a strip-like piece, which is in turn applied to the paperboard sheet at its one edge side on the bedplate so that nearly one half part of the adhesive tape piece may cover the one edge of the paperboard sheet. Then the paperboard sheet thus attached at its one edge with the strip-like tape piece is delivered through delivery rollers and transferred to the winding core shaping station located at the upper part of the three-spindle turret winder. At that station, the paperboard sheet is rolled and lapped around a winding core shaft, and resulting butt joining parts of the rolled paperboard sheet are united with the other half part of the adhesive tape piece together and fastened, whereby each shaped cylindrical winding core is ultimately obtained.

When the winding cores are shaped in that shaping station in this way, the turret winder is turned according to a normal operation to move the winding cores to the winding-up station. At the winding-up station a web paid from a stock roll or a preceding step is wound up according to usual procedure. After winding-up, the turret winder is further turned to the wind-up roll removal station where the resulting wind-up rolls are withdrawn.

A series of the actions of shaping into winding cores, winding-up of a web, and removal of wind-up rolls are operated according to a preset drive in the winder, and the taking-up of the web onto winding cores is conducted, while shaping the winding cores, instead of using ready-made winding core tubes.

In the case of a two-spindle turret, the shaping station and the wind-up roll removal station are shared with each other whereas with a four-spindle turret, it is possible to conduct a series of the actions by leaving one spindle position open and making an allowance for functions of the other spindle positions.

BRIEF DESCRIPTION OF THE DRAWINGS

The embodiments of this invention will be described in more detail with reference to the accompanying drawings, in which.

DETAILED DESCRIPTION OF THE PREFERRED EMBODIMENTS

Figure 1:
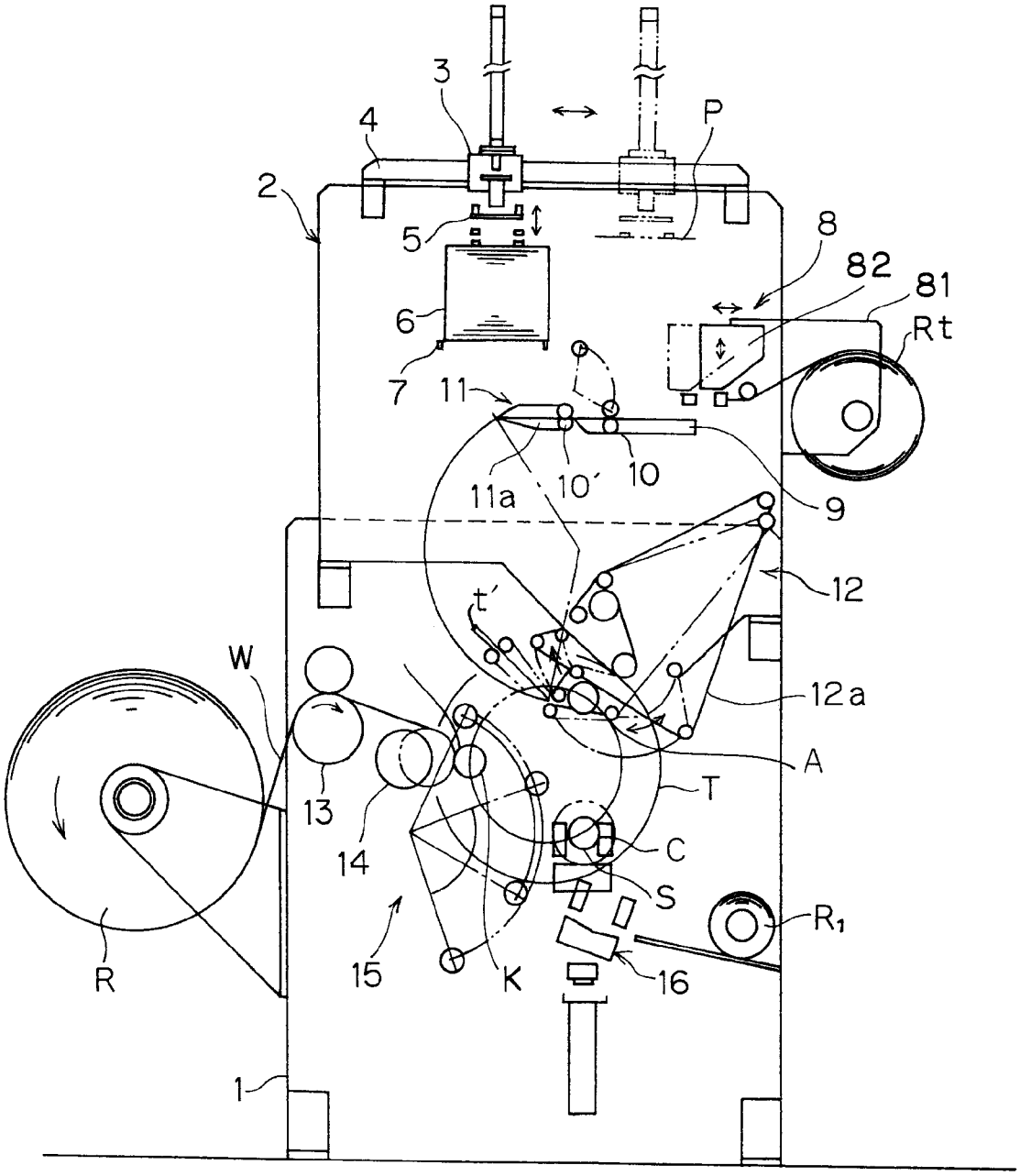
FIG. 1 is a schematic side elevational view showing one example of a winding apparatus for carrying a web winding-up method pertaining to this invention into effect.
Figure 2:
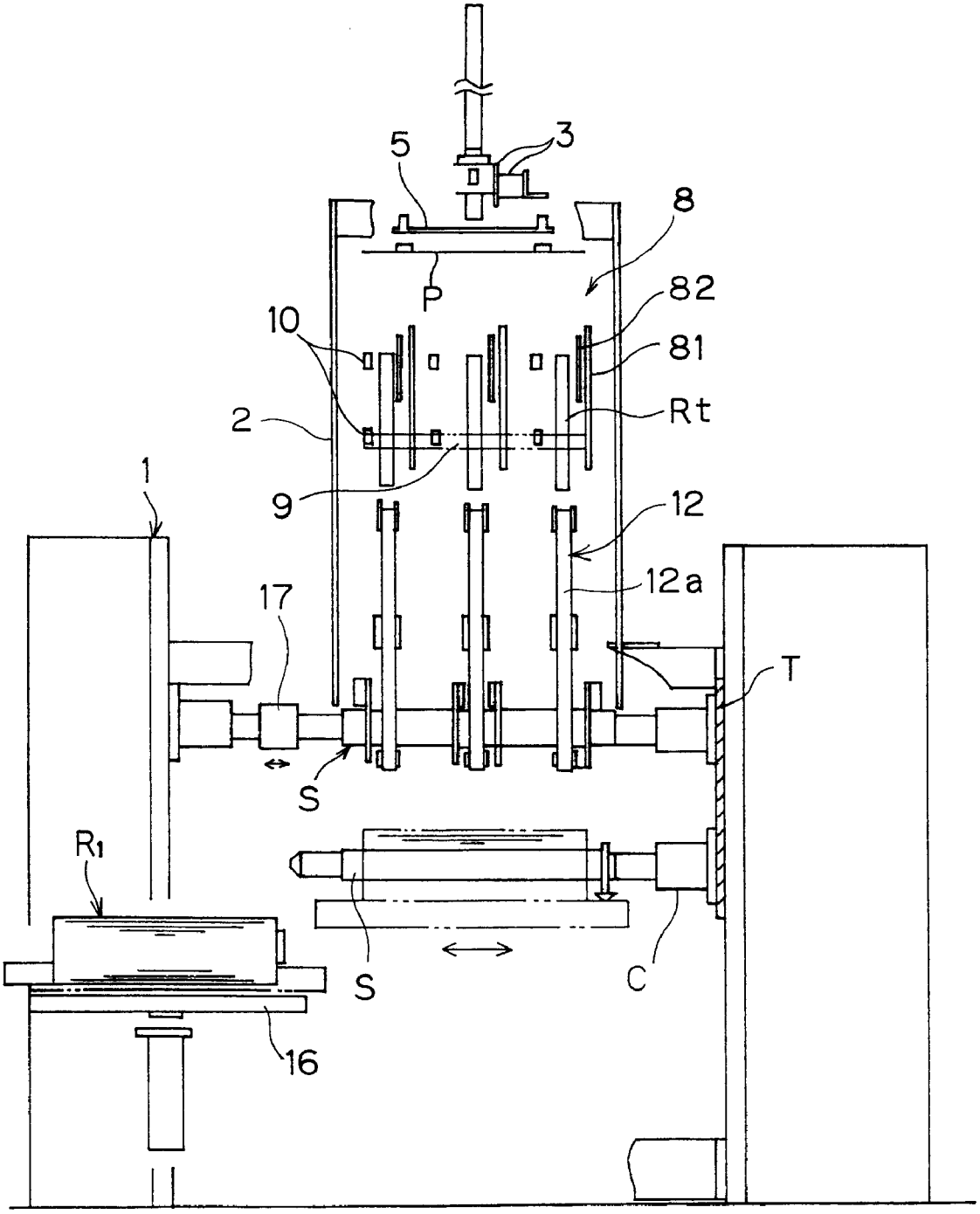
FIG. 2 is a schematic front elevation of the winding apparatus in the example of FIG. 1.
Figure 3:
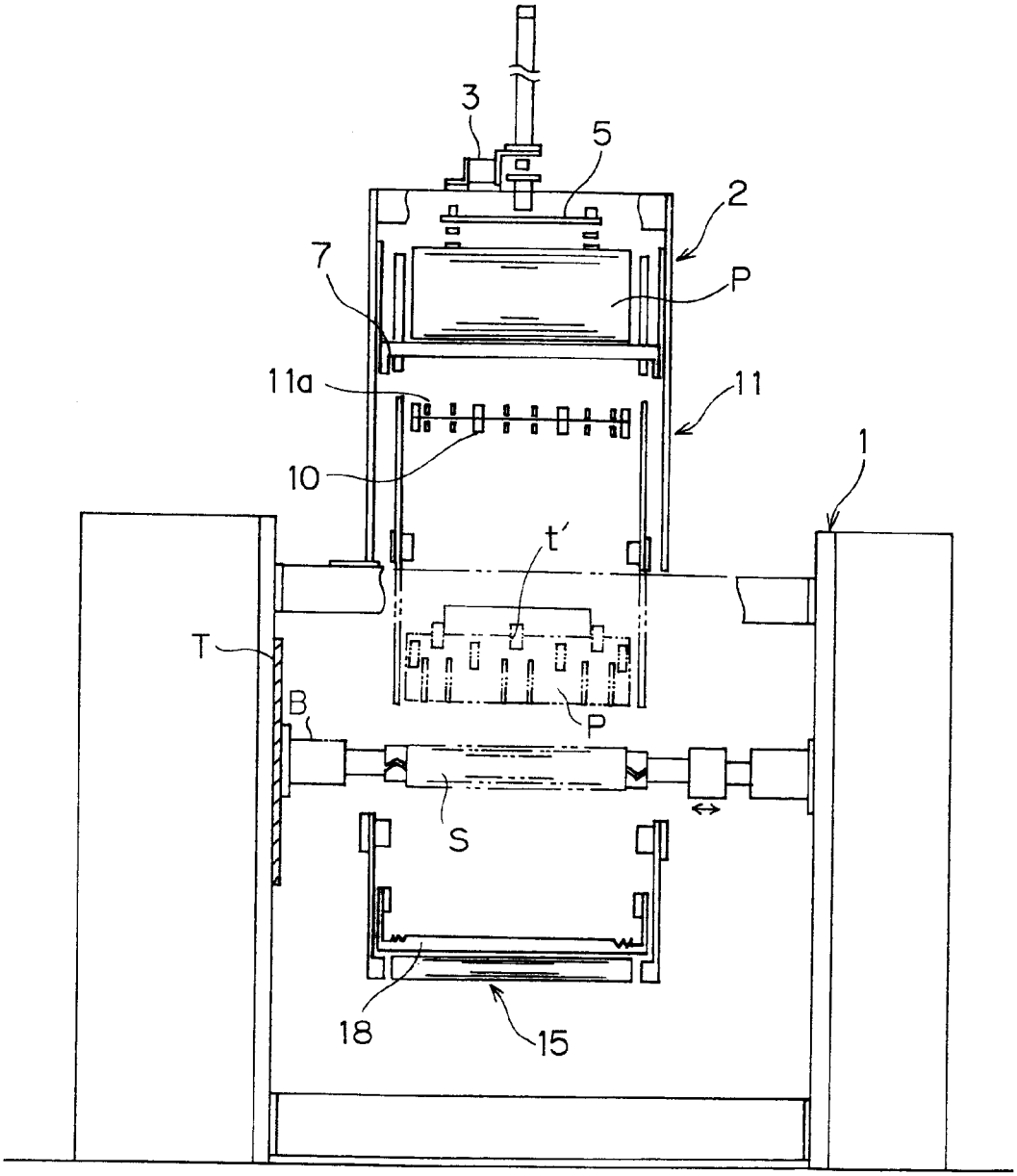
FIG. 3 is a schematic rear elevation of the apparatus in FIG. 1 with its internal structure partly omitted.

FIGS. 1 to 3 are diagrammatic views of a three-spindle turret type of winder as one example of an overall apparatus for carrying the web winding method according to this invention into effect.

In these figures, the reference numeral 1 designates a main body frame holding a three-spindle type of turret winder, within which a turret board T and a winding core shaft S are cantilevered so that the winder may be rotatable. The winder is similar to conventional turret type of winders in that a web W unreeled from a stock roll R is supplied through guide rollers 13 and a contact roller 14 to a winding core shaping station A (corresponding to a winding core supply station of a conventional turret winder); after winding, the web is cut and wrapped around a winding core K transferred to a winding-up station B where the web is wound by means of a web winding device 15; full wind-up rolls R/I thus obtained are removed at a wind-up roll removal station C with a removal device 16 known per se, which is composed of a table capable of ascending and descending, horizontally moving, and rotating, a roll edge outthrusting device, etc. In this invention, critical modifications or alterations are thus made to the conventional winding core supply station. That is, at the winding core shaping station A corresponding to a conventional winding core supply station, there is equipped an apparatus for shaping winding cores that functions to shape winding cores directly from paperboard sheets (inclusive of synthetic paper sheets), instead of using conventional ready-made winding cores tubes in a hollow cylindrical form.

Stated another way, in the illustrated example of the three-spindle turret type of winder, the winding station B and the wind-up roll removal station C are constructed, as is the case with conventional winders, but the conventional winding core supply station is constructed as the winding core shaping station A that includes the apparatus for shaping winding cores.

It should be appreciated that the winding of the present invention is not limited to a web unreeled out from a stock roll as illustrated, but applicable also to an embodiment in which a web fed continuously from a preceding step is wound up.

The reference numeral 2 designates a frame, on which the winding core shaping apparatus is installed, which is provided in association with and upwardly of the main frame body 1 of the three-spindle turret winder. At an upper part of the frame 2 there are provided a table 7 loading thereon paperboard sheets P stacked one upon another, a sucking device 5 for sucking the paperboard sheets P one by one from an uppermost layer thereof fitted with a lifting mechanism, and a traveler 3 running sideways along a guide 4 to shift the paperboard P sucked by means of the sucking device 5. At a position where a sheet of the paperboard P sucked shifts and thereafter descends, an adhesive tape application bedplate 9 for conducting the work of applying thereon a pressure-sensitive adhesive tape to one edge of the paperboard is provided. In the vicinity of a side part of the application bedplate 9, an adhesive tape applying device 8 for unreeling, cutting and applying the adhesive tape is provided.

Figure 4:
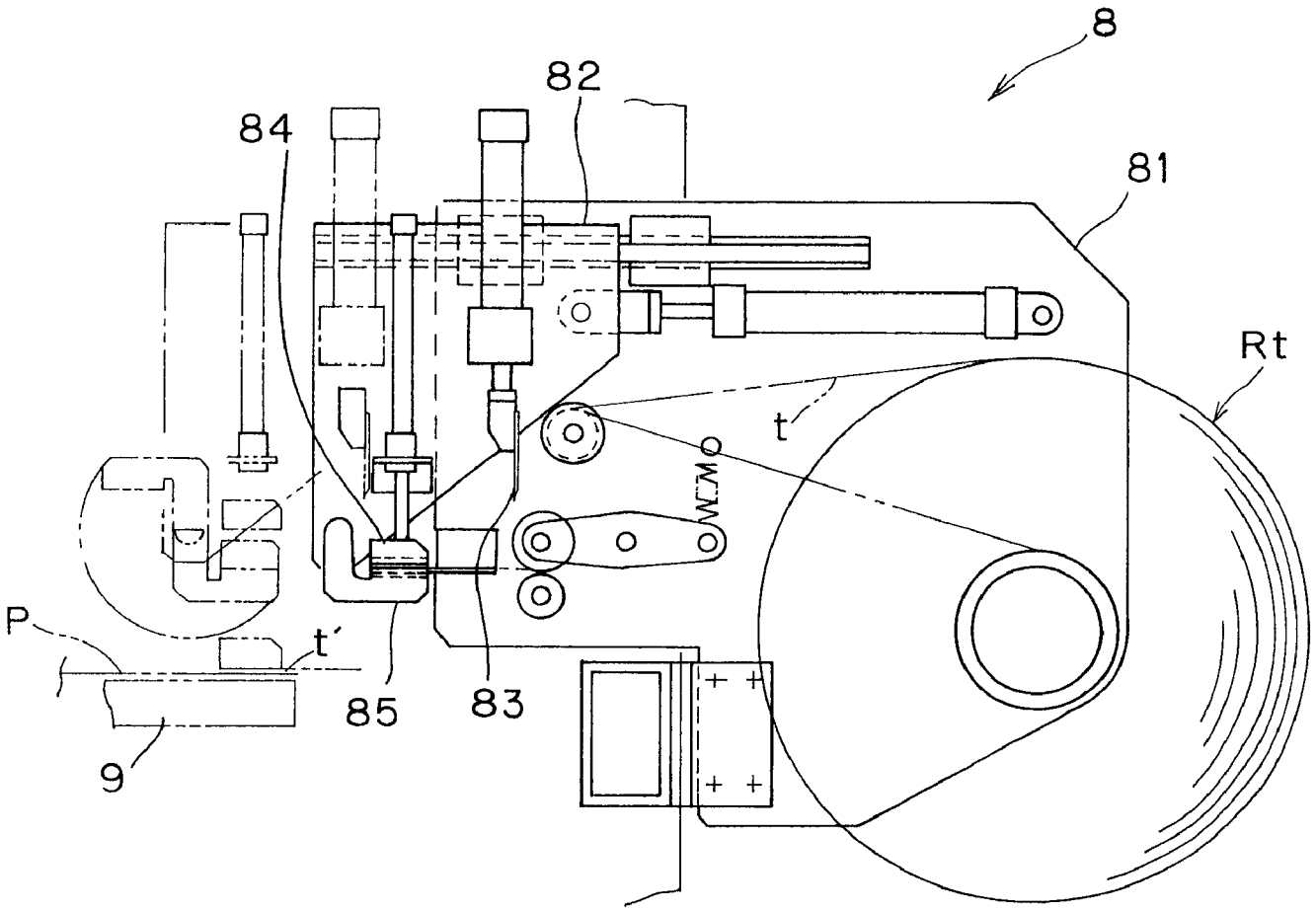
FIG. 4 is a schematic side elevational view showing a tape applying and adhering device.

The adhesive tape applying device 8 for unreeling, cutting and attaching the adhesive tape of onto the paperboard sheet on its one edge is constructed as shown in FIG. 4 and has a stationary frame 81 and movable frame 82 slidably movable fore and aft along the stationary frame. On the stationary frame 81, there is held an adhesive tape stock roll Rt, which is taken up by the tape t with an inner side of the tape being an adhesive face, so that the adhesive tape t is paid from it. On the stationary frame 81, delivery rollers for delivering the adhesive tape t guided through a guide roller forward relative to the advancing direction (the left side of the figure) while pinching the tape t whereas on the movable frame 82, a cutter 83 for cutting the tape thus delivered in a required length to a strip-like tape piece t' is provided to be movable up and down. In front of the cutter 83 there are provided a pair of upper and lower dampers for pinching a front half part of the tape piece t' therebetween, which consists of a lift type (ascendable and descendable) upper damper 84 with a sucking function for an upside of the tape t' and a rotary type lower damper 85 for an underside of the tape t'. The upper and lower dampers 84, 85 are capable of operating so that when the movable frame 81 slides and the upper and lower dampers 84, 85 advance above the tape application bedplate 9, the lower damper 85 turns to retract whereas the upper damper 84 moves downwardly, sucking and holding the front half part of the tape t' and attaches and adheres the tape t' to the paperboard sheet P riding on the bedplate 9, with the rear half part of the tape ' extending out of a rear edge of the paperboard sheet P (the right side of the figure), and then after releasing the sucking and holding function, moves upwardly.

When the paperboard sheet is attached and adhered with the adhesive tape t' on the aforesaid tape applying device 8, the paperboard sheet with the adhesive tape t' is transferred to the winding core shaping station A of the three-spindle turret winder. There it is wrapped around an expandable and contractible winding core shaft S which is supported at that position by means of chucks 17 supporting extremities of the core shaft S and imparting a center rotation force whereby to form a winding core K. To that end, a winding core shaping apparatus is provided, which comprises a set of delivery rollers 10, located adjacent to the application bedplate 9, for delivering the paperboard sheet P attached with the adhesive tape t' from the tape application bedplate 9; a paperboard transfer device 11 including a crow beak-like paperboard holder 11*a* for transferring the paperboard sheet thus delivered to the winding core shaping station A of the turret and a rotary arm (not shown) for turning the paperboard holder 11*a* up to the winding core shaping station A; and a paperboard lapping device 12 for rolling and lapping the paperboard sheet so transferred about the winding core shaft S positioned at the winding core shaping station A, which is provided at a location where the paperboard transfer device 11 is turned and moved. The paperboard lapping device 12 is of a bet-enfolding type of device for embracing the winding core shaft S with the paperboard sheet, and includes an endless belt 12*a* so that the paperboard sheet in a flat plane form may be guided with the enfolding endless belt 12*a* about the winding core shaft S thereby being shaped into each winding core K.

Figure 5A:
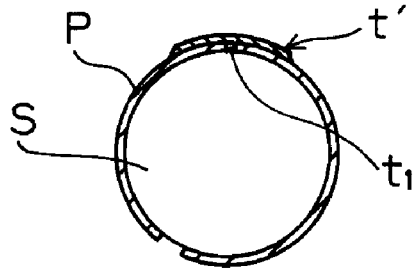
FIG. 5A, FIG. 5B and FIG. 5C are diagrammatic views showing respective forms of a winding core as shaped, namely, a sectional view of a single winding core, a sectional view of a double winding core, and a perspective view of a winding core, respectively.

The shaping of the winding cores K, which constitutes an essential part of the invention, will be described in more detail. According to this invention the winding core K assumes such a configuration that the paperboard sheet P is lapped around the winding core shaft S as shown in FIGS. 5A, 5B and 5C and resulting butt joining parts t1 are attached and fastened with the adhesive tape t'.

Here, the size of each sheet of paperboard is made the same as or a little longer than the width of the web to be wound in the elongate direction of the winding core shaft S, and the same as or a little shorter than the outside peripheral length of the winding core shaft S in the square direction to the elongate direction.

In rolling and lapping each sheet of paperboard P around the winding core shaft S, the paperboard can assume, for example, a single winding core, a double winding core or the like and can be chosen appropriately. For example, the single winding core can be produced, as shown in FIG. 5A, by lapping a sheet of the paperboard P around the winding core shaft S and attaching the butt joining parts t1 with the adhesive tape t' at several places as shown in FIG. 5C. Usually the butt joining parts t1 of the paperboard sheet P are abutted together. However, depending upon the kind and physical properties of the web used, it is preferred to provide a slight interstice at the butt joining parts by making the length of the paperboard slightly shorter than the peripheral length of the shaft S, taking a possible shrinkage with the lapse of time due to a residual wind-up stress of the wind-up roll into account.

Figure 5B:
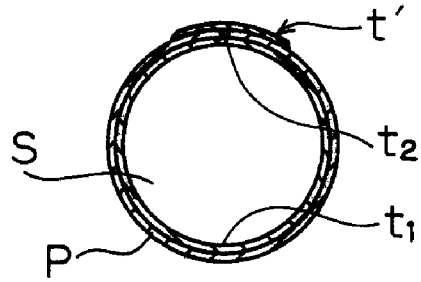
Figure 5C:
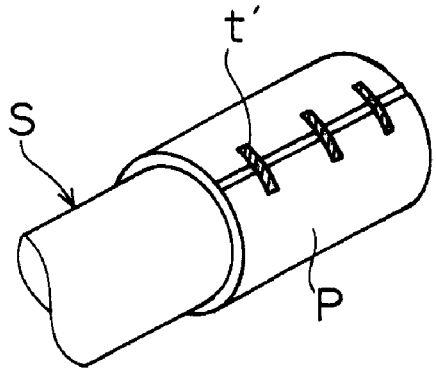

On the other hand, the double winding core is obtainable by lapping a first sheet of paperboard P on the winding core shaft S and then rolling a second sheet of paperboard outside it to attach its butt joining parts t2 with the adhesive tape t' so that the butt joining parts t1 of the first paperboard sheet may not overlap with butt joining parts t2, but preferably, may be substantially opposite to them, as shown in FIG. 5B.

Now the shaping of winding cores K as mentioned above will be described. Respective devices having a winding core shaping function provided on the frame 2 as illustrated in FIGS. 1 to 3 are actuated, first to suck an uppermost layer of paperboard sheet P on the table 7 located at an upper part of the frame 2 and loaded thereon with a stacked paperboard layer 6 by means of the lift type of paperboard sheet sucking device 5. The sucking device 5 is in turn moved by traveling of the traveler 3 toward the front side (the right side of FIG. 1), and at a predetermined position to which the traveler 3 is moved, is depressed downwardly to transfer the paperboard sheet P onto the adhesive tape application bedplate 9.

When the paperboard sheet P is transferred in this way, the left side of it is nipped with the first delivery rollers 10. At that time the driving of the rollers 10 is stopped. In that condition, the aforesaid adhesive tape applying device 8 is sequentially actuated, which is composed of the lift type upper damper 84 with a sucking function, the rotary lower damper 85 for the underside of the tape, the tape cutter 83, the fore-and-aft movable frame 82, etc. That is, from the right side of the paperboard sheet on the adhesive tape application bedplate 9, the strip-like tape t' is attached so that its adhesive side is underside and nearly a half of it is applied. The pressure-sensitive adhesive tape t' is not applied over the overall width of the paperboard sheet, but attached in the form of strip-like tape piece(s) at one place or several places at an appropriate interval.

After applying and adhering of the adhesive tape piece(s) t' at one edge of the paperboard sheet, the first delivery rollers 10 for paperboard sheets positioned at the tape application bedplate 9 and a second set of delivery rollers 10'0 for paperboard sheets positioned at the paperboard transfer device 11 revolve in the same peripheral speed to deliver the left edge of the paperboard sheet up to the top of the crow beak like paperboard holder 11 a and stop there.

Figure 6:
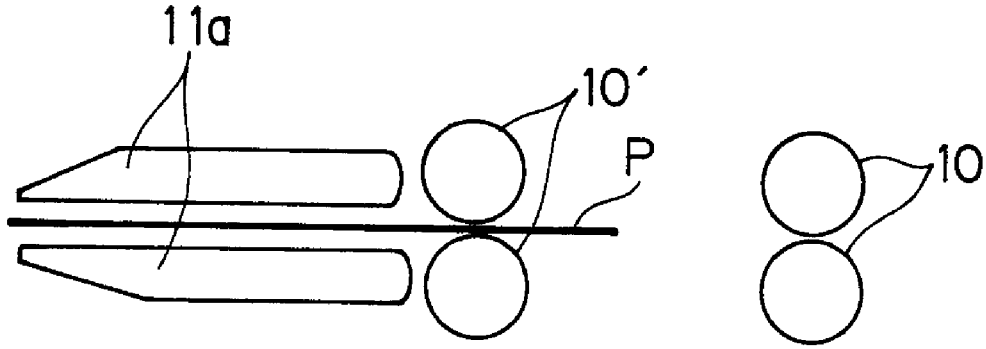
FIG. 6 is a schematic representation illustrating the state that a paperboard sheet is delivered from a transfer device of paperboard sheets.

At that time, the right side of the paperboard sheet passes completely the position of the first delivery rollers 10, but stops short of the second delivery rollers 10'. The paperboard sheet P is thereby being clamped in the paperboard transfer device 11 as illustrated in FIG. 6.

In the winder, the first delivery rollers 10 and the second delivery rollers 10' for each paperboard sheet are equipped in plural sets separated in the axial direction, and the crow beak-like holder 11*a* is also equipped in plural sets of crow beak-like members in a narrow width. However, any sets of the delivery rollers 10, 10' and the crow beak-like members of the holder 11*a* are equipped each at a place evading the passageway where the adhesive tape runs or passes through.

The paperboard sheet, in the state of being clamped in the paperboard transfer device 11, is then transferred toward the paperboard rolling and lapping device 12 which is provided adjacency to the winding core shaping station A of the turret winder.

Figure 7A:
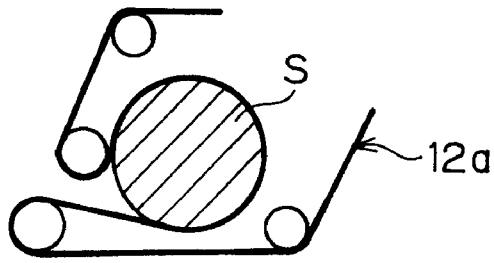
FIG. 7A, FIG. 7B and FIG. 7C are schematic representations of a paperboard rolling and lapping device showing the states that each paperboard sheet is rolled and lapped, i.e., the state that a winding core shaft is embraced with a belt, the state that the paperboard sheet is inserted into the paperboard rolling device, and the state that the paperboard sheet is rolled and lapped around the winding core shaft, respectively.
Figure 7B:
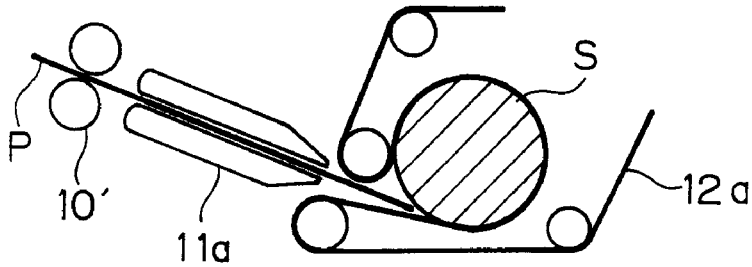

The paperboard rolling and lapping device 12 is provided with the endless belt 12*a* for conveying, which is operated to embrace the winding core shaft S located at the winding core shaping station A within it as illustrated in FIG. 7A. And the tip of the paired crow beak-like members of the paperboard holder 11*a* is fronted to an interstice between a starting contact point and a final contact point of the winding core shaft S, with the endless belt 12*a* embracing therein the winding core shaft S, as shown in FIG. 7B.

Figure 7C:
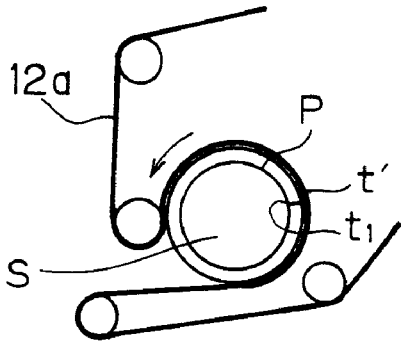

In that state, the second paperboard delivery rollers 10' and the endless belt 12*a* are actuated, and the paperboard sheet P is inserted between the belt 12*a* and its contact face with the winding core shaft S to advance along the periphery of the winding core shaft S, whereby the paperboard sheet P is shaped into a cylinder form (the winding core K), as shown in FIG. 7C.

Here, the left side edge and the right side edge of the paperboard sheet P are butt joined to each other at a place coming nearly full circle around the winding core shaft, leaving more or less an interstice, and the butt joining parts are attached and adhered together at outer peripheral faces thereof with the adhesive tape t' in strip pieces (cf. FIG. 5C).

The endless belt 12*a* is installed in the same number as the number of the adhesive tape t (adhesive tape stock roll Rt) as shown in FIG. 2 and is operated in conformity with the position of the tape so that the adhesive face of the tape may be ensured in pressure contact with the outer circumferential surface of the paperboard.

After the winding core K is thus shaped, the endless belt 12*a* is driven to release the winding core K and the winding core shaft S embraced, and is retreated from the paperboard rolling and lapping position.

Thereafter the winding core K is transferred with the turning movement (indexing) of the turret T to the winding-up station B, where winding is performed to produce a full wind-up roll R1, which is in turn transferred to the removal station C and removed whereas at the winding-up station B, the web cutting and wrapping device 15 is actuated to cut the web on a cutter 18 and to wrap the cut end on the next winding core K, according to the usual procedure.

The example of shaping with a single winding core has been described above, and this is basically likewise applicable to the case with a double winding core for reinforcement That is, first, when the inner sheet of paperboard is shaped, the attachment of the adhesive tape strip pieces is not necessarily needed, but can be omitted. It is only essential here that the state that the paperboard is lapped around the winding core shaft by the endless belt be securely retained at the time when the first sheet of paperboard has been shaped in a cylinder form. Thereafter it will suffice that after the first inner paperboard sheet has been shaped, the shaping of the second sheet of paperboard be conducted in the same order as that of the aforementioned shaping of the single winding core. However, the step of embracing the winding core shaft in the belt is not particularly needed since the winding core shaft is already held by the first paperboard sheet.

According to this invention, the winding of a web can be done in association with the shaping of winding cores as described above, and it is possible to shape paperboard sheets into cylindrical winding cores within the winder without use of paper tubes which have conventionally been used.

The foregoing explanation was made with the case where sheets of paperboard are supplied one by one from the table loaded thereon with them. In this invention It is also possible to pay paperboard in the form of a web out continuously from a paperboard roll rolled up instead of picking up paperboard sheets one by one, thereby to continuously supply paperboard sheets for shaping of winding cores.

The embodiment described above is concerned with a three-spindle turret type of winder, but the invention is not limited to the three-spindle turret type and can also be applied to two-spindle or four-spindle turret type ones. In the case of a two-spindle type one, the winding core shaping station A and the wind-up roll removal station C are shared with each other so that after removal of the wind-up roll, the winding core shaping function may be carried out. With a four-spindle type one, one of the spindle positions, usually the position between the winding core shaping station A and the wind-up roll removal station C is left open as a play, whereby it is possible to leave an allowance for the functions of respective stations.

Thus it is possible to use a multiple-spindle turret type of winder in this invention, thereby to conduct efficiently the shaping of winding cores, winding, and removal of full wind-up rolls with one cycle of turning movement of the turret instead of using ready-made paper tubes or the like.

To summarize, the present invention resides, as described above, in imparting the winding core shaping function to a multi-spindle type of winder itself, namely, shaping winding cores directly in the winder without relying on ready-made winding core tubes and conducting the winding. It is a salient, epoch making feature of this invention that it is possible to conduct an automatic shaping of winding cores, if only paperboard sheets are supplied, followed by winding and removal of wind-up rolls. Since the winding is conducted while shaping paperboard sheets into winding cores of a cylinder form, its working efficiency is not impaired at all. To be more important, the disposal of used winding cores as industrial wastes, as necessitated so far with ready-made paper core tubes used in existing winders, is no longer needed and besides, there is no necessity of bearing the costs for transportation and reuse of them. This is because after the wind-up rolls thus produced are rewound and used up, the cylindrical winding cores shaped from sheets of paperboard can be restored readily to initial flat paperboard sheets and so can be simply disposed of. Therefore this invention is advantageous and suited to the current environmental requests.

What is claimed is:

1. A method of winding up a web on winding cores by use of a multi-spindle turret type of winder, which comprises the sequential steps of:

lapping each sheet of a paperboard about a winding core shaft and attaching butt joining parts of both edges of the paperboard sheet with a pressure-sensitive adhesive tape thereby shaping it into each winding core;

winding up the web onto the shaped winding cores;

and subsequently removing resulting full wind-up rolls wound on the winding cores from the winder, the aforementioned sequential steps being conducted in conformity with a turning movement of the turret within the winder.

2. The method of winding up a web on winding cores on a multi-spindle turret type of winder as set forth in claim 1, wherein the winding core shaping step comprises clamping and transferring the pressure-sensitive adhesive tape while pinching it between a pair of upper and lower dampers to attach and adhere it to the paperboard sheet at its one edge, inserting the paperboard sheet with the tape into a nip between a winding core shaft and an embracing endless belt, and rolling and lapping the paperboard sheet about the winding core shaft to unite the butt joining parts together by attaching the adhesive tape to the other edge.

3. A multiple-spindle turret type of winder, wherein spindle positions of the turret are allotted to a winding core shaping station, a web winding-up station and a removal station of full wind-up rolls;

which is equipped, in association with the winding core shaping station, with a winding core shaping apparatus; a web winding device onto the winding cores; and a removal device of full-wind rolls from the winder;

the winding core shaping apparatus comprising a paperboard transfer means for picking up and transferring sheets of paperboard one by one to a tape application bedplate for attaching thereon a pressure-sensitive adhesive tape to the paperboard sheet; a tape applying mechanism for unreeling the adhesive tape, cutting it in an adequate length and applying the cut adhesive tape to one edge of each paperboard sheet thus transferred to the tape application bedplate; a transfer device for transferring the paperboard sheets thus treated at their one edge with the adhesive tape to the winding core shaping station where to shape the paperboard sheets one by one into winding cores; and a paperboard rolling and lapping device for rolling and lapping each paperboard sheet thus transferred around a winding core shaft positioned at the winding core shaping station and for uniting butt joining parts of the paperboard sheet thus rolled to each other with the adhesive tape at both edges thereof;

the winding core shaping apparatus, the web winding device and the removal device of full-wind rolls being capable of operating in sequence in association with the winding core shaping station, the web winding-up station and the removal station of full-wind rolls, respectively by the turning movement of the turret.

4. The multi-spindle turret type of winder as set forth in claim 3, wherein the tape applying device includes an adhesive tape cutter for cutting a pressure-sensitive adhesive tape to tape pieces; an upper lift type of damper having a sucking function and a lower rotary damper for clamping the cut tape therebetween, the upper damper being movable fore and aft toward the bedplate and ascendable and descendable, the lower damper being rotatable to recede after application of the tape so that a front half of the cut adhesive tape may be attached to the paperboard at its rear edge.

5. The multi-spindle turret type of winder as set forth in claim 3, wherein the transfer device includes a crow beak-like holder for holding therein the paperboard sheet and paperboard delivery rollers for delivering the paperboard with the tape to the winding core shaping station.

6. The multi-spindle turret type of winder as set forth in claim 3, wherein the paperboard rolling and lapping device includes an enfolding endless belt with which to roll and lap the paperboard with the tape around a winding core shaft, whereby uniting the butt joining parts of the paperboard with the tape together at both edges.

* * * * *

UNITED STATES PATENT AND TRADEMARK OFFICE

CERTIFICATE OF CORRECTION

PATENT NO. : 6,676,065 B1
DATED : January 13, 2004
INVENTOR(S) : Toshio Kashima

It is certified that error appears in the above-identified patent and that said Letters Patent is hereby corrected as shown below:

Column 4,
Line 59, change “dampers” to -- clampers --.
Line 61, change “damper” to -- clamper --.
Line 63, change “damper” to -- clamper --.
Line 64, change “dampers” to -- clampers --.
Line 66, change “dampers” to -- clampers --.
Line 67, change “damper” to -- clamper --.

Column 5,
Line 1, change “damper” to -- clamper --.

Column 6,
Line 23, change “damper” to -- clamper --.
Line 24, change “damper” to -- clamper --.

Column 8,
Line 54, change “dampers” to -- clampers --.

Column 10,
Lines 6, 7, 8 and 10, change “damper” to -- clamper --.

Signed and Sealed this

Twenty-ninth Day of June, 2004

JON W. DUDAS
*Acting Director of the United States Patent and Trademark Office*